US010210753B2

(12) United States Patent
Russell et al.

(10) Patent No.: US 10,210,753 B2
(45) Date of Patent: Feb. 19, 2019

(54) TRAFFIC MONITOR AND METHOD

(71) Applicant: Eberle Design, Inc., Phoenix, AZ (US)

(72) Inventors: William Russell, Phoenix, AZ (US); William Sowell, Mesa, AZ (US); Joseph Dudich, Phoenix, AZ (US); Matt Zinn, Cave Creek, AZ (US); Timothy McCall, Phoenix, AZ (US)

(73) Assignee: Eberle Design, Inc., Phoenix, AZ (US)

( * ) Notice: Subject to any disclaimer, the term of this patent is extended or adjusted under 35 U.S.C. 154(b) by 0 days.

(21) Appl. No.: 15/339,754

(22) Filed: Oct. 31, 2016

(65) Prior Publication Data

US 2017/0124865 A1 May 4, 2017

Related U.S. Application Data

(60) Provisional application No. 62/249,264, filed on Nov. 1, 2015.

(51) Int. Cl.

| | |
|---|---|
| ***G08G 1/095*** | (2006.01) |
| ***G08G 1/07*** | (2006.01) |
| ***G08G 1/01*** | (2006.01) |
| ***G08G 1/08*** | (2006.01) |
| ***G08G 1/0967*** | (2006.01) |
| ***G08G 1/097*** | (2006.01) |

(52) U.S. Cl.

CPC ..... *G08G 1/07* (2013.01); *G08G 1/0112* (2013.01); *G08G 1/0116* (2013.01); *G08G 1/0133* (2013.01); *G08G 1/0141* (2013.01); *G08G 1/08* (2013.01); *G08G 1/097* (2013.01); *G08G 1/096716* (2013.01); *G08G 1/096758* (2013.01); *G08G 1/096775* (2013.01)

(58) Field of Classification Search

CPC .. G08G 1/00; G08G 1/01; G08G 1/07; G08G 1/08; G08G 1/0125; G08G 1/095

USPC ..... 340/907, 909, 910, 916, 917

See application file for complete search history.

(56) References Cited

U.S. PATENT DOCUMENTS

| | | | |
|---|---|---|---|
| 5,465,289 | A | 11/1995 | Kennedy, Jr. et al. |
| 5,926,101 | A | 7/1999 | Dasgupta |
| 6,633,238 | B2 | 10/2003 | Lemelson et al. |
| 6,791,472 | B1 | 9/2004 | Hoffberg |
| 6,911,918 | B2 | 6/2005 | Chen |
| 7,613,564 | B2 | 11/2009 | Vorona |
| 7,706,965 | B2 | 4/2010 | Downs et al. |
| 7,791,503 | B2 | 9/2010 | Breed et al. |
| 7,813,870 | B2 | 10/2010 | Downs et al. |
| 7,912,628 | B2 | 3/2011 | Chapman et al. |
| 7,979,198 | B1 | 7/2011 | Kim et al. |
| 8,160,805 | B2 | 4/2012 | Downs et al. |
| 8,368,559 | B2 | 2/2013 | Pixley et al. |

(Continued)

FOREIGN PATENT DOCUMENTS

WO 2012-013228 2/2012

*Primary Examiner* — Toan N Pham

(57) ABSTRACT

In accordance with an embodiment, a method for processing information associated with vehicular traffic includes generating an input signal that contains information associated with vehicular traffic and transmitting the information to a cloud-based server system. A control signal is generated in response to the information. In accordance with another embodiment, a traffic monitoring system has a data aggregator coupled to a malfunction management unit and to a traffic signal controller coupled to the data aggravator.

10 Claims, 3 Drawing Sheets

(56) References Cited

U.S. PATENT DOCUMENTS 8,483,940 B2 7/2013 Chapman et al.
8,682,571 B2 3/2014 Chapman et al.
8,976,041 B2 3/2015 Buckel
9,860,677 B1 * 1/2018 Agerstam ..... H04W 4/005
2001/0029425 A1 10/2001 Myr
2002/0085498 A1 7/2002 Nakamichi et al.
2004/0230373 A1 11/2004 Tzamaloukas
2006/0181433 A1 * 8/2006 Wolterman ..... G08G 1/08 340/917
2007/0142037 A1 6/2007 O'Toole et al.
2008/0059050 A1 3/2008 Lin et al.
2008/0094250 A1 * 4/2008 Myr ..... G08G 1/04 340/909
2008/0288162 A1 11/2008 Theimer et al.
2009/0112452 A1 4/2009 Buck et al.
2009/0153364 A1 6/2009 Buchalo et al.
2009/0210141 A1 8/2009 Young et al.
2009/0271100 A1 10/2009 Kim et al.
2009/0309966 A1 12/2009 Chen et al.
2010/0004849 A1 1/2010 Jeong
2010/0094532 A1 4/2010 Vorona
2010/0203834 A1 8/2010 Bragagnini et al.
2010/0254282 A1 10/2010 Chan et al.
2011/0109478 A1 * 5/2011 Williamson ..... G08G 1/087 340/906
2011/0130947 A1 6/2011 Basir
2011/0156924 A1 6/2011 Nadeem et al.
2011/0248867 A1 * 10/2011 Lee ..... G08G 1/0104 340/905
2011/0309952 A1 * 12/2011 Gubbe ..... G08G 1/07 340/925
2012/0083996 A1 4/2012 Tas et al.
2013/0006510 A1 1/2013 Young et al.
2013/0063282 A1 3/2013 Baldwin et al.
2013/0184938 A1 * 7/2013 Dolinar ..... G01C 15/02 701/41
2014/0149028 A1 5/2014 Chapman et al.
2014/0195138 A1 7/2014 Stelzig et al.
2015/0057913 A1 2/2015 Benhammou
2016/0055744 A1 * 2/2016 Branson ..... G08G 1/07 340/916
2016/0351048 A1 * 12/2016 Thompson ..... G08G 1/07

* cited by examiner

TRAFFIC MONITOR AND METHOD

The present application is a nonprovisional application of U.S. Patent Application No. 62/249,264 filed on Nov. 1, 2015 by William Russell et al., titled "TRAFFIC MONITOR AND METHOD" which is hereby incorporated by reference in its entirety, and priority thereto for common subject matter is hereby claimed.

The present invention relates, in general, to traffic monitoring systems and methods for processing traffic information.

A signal monitor is a device used in traffic control assemblies to detect and respond to conflicting or otherwise improper signals. Such improper signals may arise, for example, due to field signal conflicts, a malfunctioning controller, faulty load switches, cabinet mis-wiring, improper supply voltages, and the like. For example, when one or more certain critical failures occur, the signal monitor instructs (or causes other components to instruct) the signal lights to enter an emergency "flash" mode, in which the traffic lights on all sides of the intersection generally enter a flashing red state or an amber state. A flasher is a device in the traffic control assembly that delivers power to the selected signal light when operating in a flashing mode. Flash transfer relays are used to switch the source of the traffic signal power from load switches to the flasher.

It is often the case that certain other events external or internal to the traffic control cabinet occur that should be attended to, but which do not typically require the intersection to enter the flash mode. Such events include, for example, damage to the controller cabinet, problems with the cabinet power supplies, data communications issues, and relatively non-critical signal light conditions (such as faulty "DON'T WALK" signals, minimum green time violations, etc.). Some prior art signal monitors include additional logic outputs that provide more detailed status information to the controller, but such information is only provided in cases where a critical fault has occurred, and the intersection is already in a flash mode.

Accordingly, it would be advantageous to have improved signal monitor systems and methods that may collect data regarding traffic such as, for example, traffic volume or traffic issues and use this data to improve travel. It would be of further advantage for the signal monitor system and method to be cost efficient to implement.

BRIEF DESCRIPTION OF THE DRAWINGS

The present invention will be better understood from a reading of the following detailed description, taken in conjunction with the accompanying drawing figures, in which like reference characters designate like elements and in which.

Figure 1:
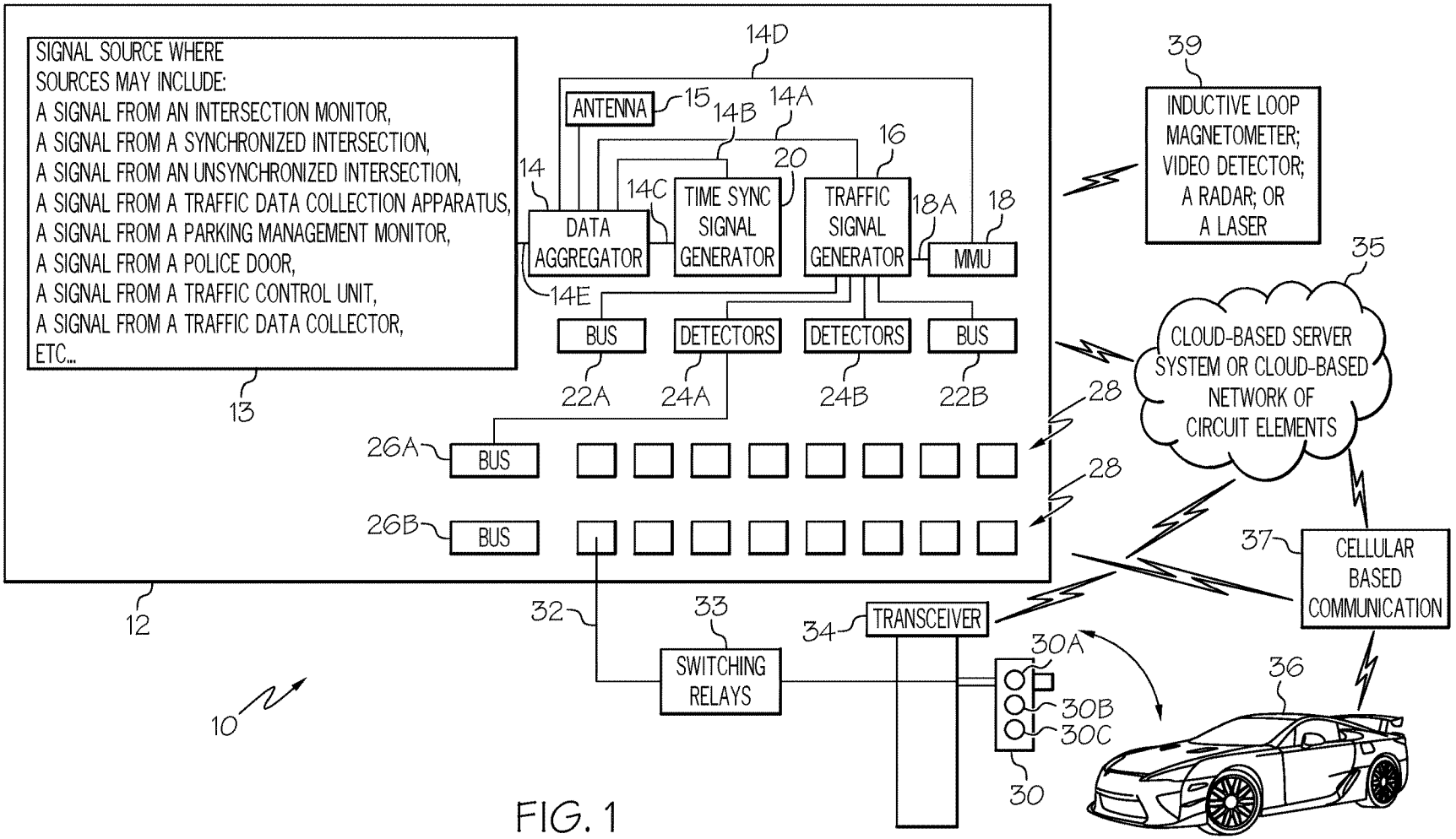
FIG. 1 is a block diagram of a traffic monitoring system in accordance with an embodiment of the present invention.

It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action and the initial action. The use of the word approximately, about, or substantially means that a value of an element has a parameter that is expected to be very close to a stated value or position. However, as is well known in the art there are always minor variances that prevent the values or positions from being exactly as stated.

Terms of enumeration such as "first," "second," "third," and the like may be used for distinguishing between similar elements and not necessarily for describing a particular spatial or chronological order. These terms, so used, are interchangeable under appropriate circumstances. The embodiments of the invention described herein are, for example, capable of use in sequences other than those illustrated or otherwise described herein. Unless expressly stated otherwise, "connected," if used herein, means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically.

The terms "comprise," "include," "have" and any variations thereof are used synonymously to denote non-exclusive inclusion. The terms "left," "right," "in," "out," "front," "back," "up," "down," and other such directional terms are used to describe relative positions, not necessarily absolute positions in space. The term "exemplary" is used in the sense of "example," rather than "ideal."

DETAILED DESCRIPTION

The following detailed description is merely exemplary in nature and is not intended to limit the range of possible embodiments and applications. Furthermore, there is no intention to be bound by any theory presented in the preceding background or the following detailed description.

For simplicity and clarity of illustration, the drawing figures depict the general topology, structure and/or manner of construction of the various embodiments. Descriptions and details of well-known features and techniques may be omitted to avoid unnecessarily obscuring other features. For example, conventional techniques and components related to traffic control devices are not described in detail herein. Elements in the drawings figures are not necessarily drawn to scale: the dimensions of some features may be exaggerated relative to other elements to assist improve understanding of the example embodiments.

Generally, the present invention provides a traffic monitoring system and a method for managing traffic. In accordance with an embodiment, a method for processing information associated with vehicular traffic, comprises generating at least one input signal that contains the information associated with the vehicular traffic; transmitting the information associated with the vehicular traffic to a cloud-based server system; generating a control signal in response to the information associated with the vehicular traffic; and using the control signal to move a switch from a first state to a second state.

In one aspect, the information associated with the vehicular traffic comprises one or more of vehicle performance, vehicle counts, and vehicle travel information.

In another aspect, generating the at least one signal includes generating the at least one signal using one or more of an inductive loop, a magnetometer, a video detector, a radar, and a laser.

In another aspect, generating the at least one signal includes receiving an input signal selected from the group of signals comprising a signal from an intersection monitor, a signal from a synchronized intersection, a signal from a traffic data collection apparatus, a signal from a parking management monitor, a signal from a police door, a signal from a traffic control unit, and a signal from a traffic data collector. As those skilled in the art are aware, a police door is a door located on a traffic control cabinet that allows the police access to the interior of the cabinet. Circuitry is connected to the police door to transmit a signal in response to the door being opened. The circuitry could be used to indicate the status of the door, i.e., whether it is open or closed.

In accordance with another embodiment, a method for controlling traffic, comprises providing a data aggregator configured to receive data related to traffic, a traffic signal controller coupled to the data aggregator, and a malfunction management unit coupled to the traffic signal controller and to the data aggregator. Data that is related to the traffic or to a traffic control cabinet is received by the data aggregator and transmitted to a cloud-based server system. A control signal is generated in response to the data related to the traffic or the traffic control cabinet that has been transmitted to the server system and used to control an intersection.

In accordance with another embodiment, a traffic monitoring system, comprises a data aggregator having a first input terminal, a first output terminal, and an input/output terminal; a malfunction management unit having an input/output terminal, the input/output terminal of the malfunction management unit coupled to the input/output terminal of the data aggregator; and a traffic signal controller coupled to the data aggravator.

FIG. 1 is block diagram of a traffic monitoring system 10 in accordance with an embodiment of the present invention. What is shown in FIG. 1 is controller cabinet 12 configured to support and protect, for example, a data aggregator 14, a traffic signal controller 16, a Malfunction Management Unit (MMU) 18, and a time sync signal generator 20. Controller cabinet 12 may be referred to as a traffic control cabinet. Data aggregator 14 has an input terminal 14E coupled for receiving an input signal from a signal source 13. Signal source 13 may generate a signals including, but not limited to a signal from an intersection monitor; a signal from a synchronized intersection; a signal from an unsynchronized intersection; a signal from a traffic data collection apparatus; a signal from a parking management monitor; a signal from a police door; a signal from a traffic control unit a signal from a traffic data collector, etc. Data aggregator 14 includes an output terminal coupled to an antenna 15. Malfunction management unit 18 is connected to data aggregator 14 through input/output terminal 14D and to traffic signal controller 16 through terminal 18A, and time sync signal generator 20 is connected to data aggregator 14 through terminal 14B and input/output terminal 14C. Controller cabinet 12 further includes internal bus interface units 22A and 22B, detectors 24A and 24B, back panel bus interface units 26A and 26B and back panel load switches 28. Bus interface unit 26A is connected to detectors 24A and bus interface units 22A and 22B and detectors 24A and 24B are connected to traffic signal controller 16.

Components in controller cabinet 12 such as, for example, data aggregator 14 may be connected to a cloud-based network of circuit elements 35 such as processors, logic circuits, memory elements, etc. It should be noted that a cloud-based network of circuit elements may be comprised of an internet service-based data storage and analysis system and may include a cloud-based server.

FIG. 1 further illustrates that controller cabinet 12 may be connected to a traffic signal head 30 by means of wiring 32 and switches 33 or, alternatively, by means of a Dedicated Short Range Communications (DSRC) radio transceiver 34 via the Ethernet and switches 33, where the Ethernet may also be represented by box 34. Switches 33 may be referred to as switching relays or relays and may include solid state relays or electromechanical relays. Transceiver 34 is capable of transmitting signals to a traffic signal head and cloud-based network of circuit elements 35 and receiving signals from cloud-based network of circuit elements 35. Alternatively, controller cabinet 12 may be connected to a traffic signal head 30 and to cloud-based network of circuit elements 35 through a cellular-based communications system 37 with options of 3G, 4G, 5G, GSM, GPRS, or the like. It should be noted that 3G refers to the third generation of cellular-based communications systems, 4G refers to the fourth generation of cellular-based communications systems, GSM refers to a Global System for Mobile Communications, GPRS refers to a General Packet Radio Service.

Traffic signal head 30 may include lamps 30A, 30B, and 30C, where lamp 30A emits light in the red spectrum, lamp 30B emits light in the yellow spectrum, and lamp 30C emits light in the green spectrum.

In addition, a DSRC radio transceiver in a vehicle 36 may transmit to or receive information from data aggregator 12 via a DSRC radio transmitter, or cellular based communications systems 37.

Figure 2:
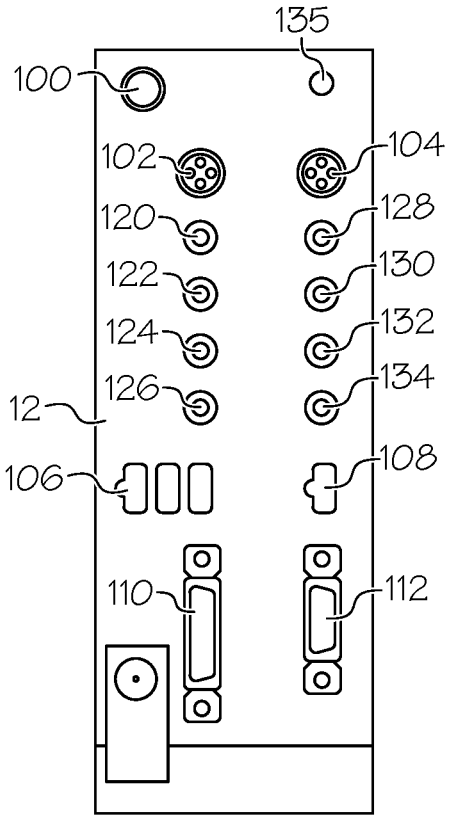
FIG. 2 is a front view of a data aggregator suitable for use with the traffic monitoring system of FIG. 1.

Data aggregator 14 transmits and receives real time intersection status and may pass signals such as, for example, Bluetooth signals, cellular based signals, Wireless Fidelity (WiFi) signals, or the like to a cloud-based server through, for example, a cellular modem. FIG. 2 is a front view of data aggregator 14 in accordance with an embodiment of the present invention. Data aggregator 14 is suitable for mounting in a traffic control cabinet 12. The front view illustrates antenna ports 100, 102, and 104 for Global Positioning System (GPS), Wireless Fidelity (WiFi), and Cellular (Cell) modems, respectively. FIG. 2 further illustrates an Ethernet input/output port 106, an Ethernet input/output port 108, and input/output ports 110 and 112 suitable for use with a Synchronous Data Link Control (SDLC) communications protocol and an Electronic Industries Alliance (EIA) 232 communication protocol, respectively. Traffic control cabinet 12 includes a plurality of auxiliary input/output ports 120, 122, 124, 126, 128, 130, 132, and 134, and a power indicator signal 135.

Figure 3:
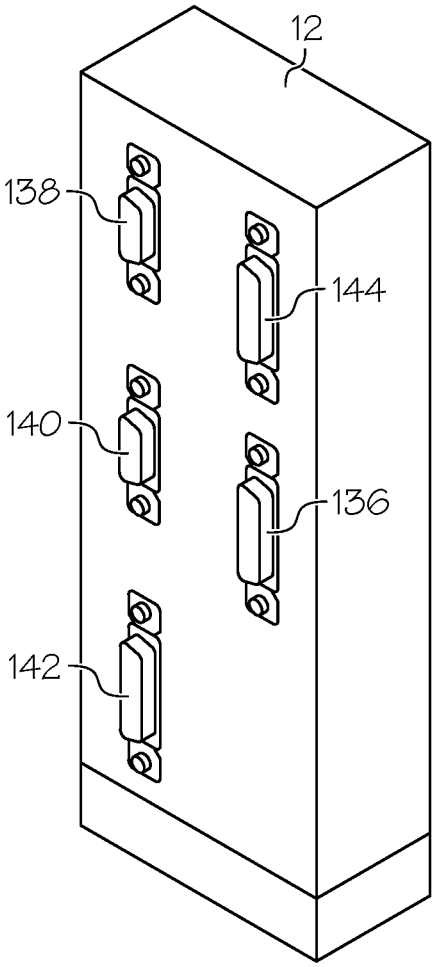
FIG. 3 is a back view of the data aggregator of FIG. 2.

FIG. 3 is a back view of traffic control cabinet 12 and illustrates analog DC 135 input 144, Digital DC input 136, analog AC inputs 138, a relay 140, and a DC power input 142. By way of example, traffic control cabinet 12 may include: eight detector/isolator serial ports; an SDLC port; two Ethernet ports; two external Universal Serial Bus (USB) ports; an external serial port; four analog inputs that range from zero to three hundred volts (alternating current, AC); four analog inputs that range from zero to thirty volts (direct current, DC); eight digital inputs that range from zero volts to thirty volts (DC); four relay digital outputs; an accessible fuse that provides isolation of at least ten megohms between digital ground and AC neutral. Data aggregator 14 can operate normally and transmit messages for at least four (4) hours without power, and can measure cabinet temperature.

MMU 18 monitors the voltages on the load switch outputs and ensures there are no conflicts, absent of signal on any channel, or dual signal indications on any channel. In addition, MMU 18 monitors the voltage on wiring 32 that is connected to traffic signal head 30 and monitors the command from traffic signal controller 16 via the SDLC communications port. If the commands don't agree, the cabinet control is taken from traffic signal controller 16 and the intersection is placed in flash mode by MMU 18. This process may be referred to as a field check.

Figure 4:
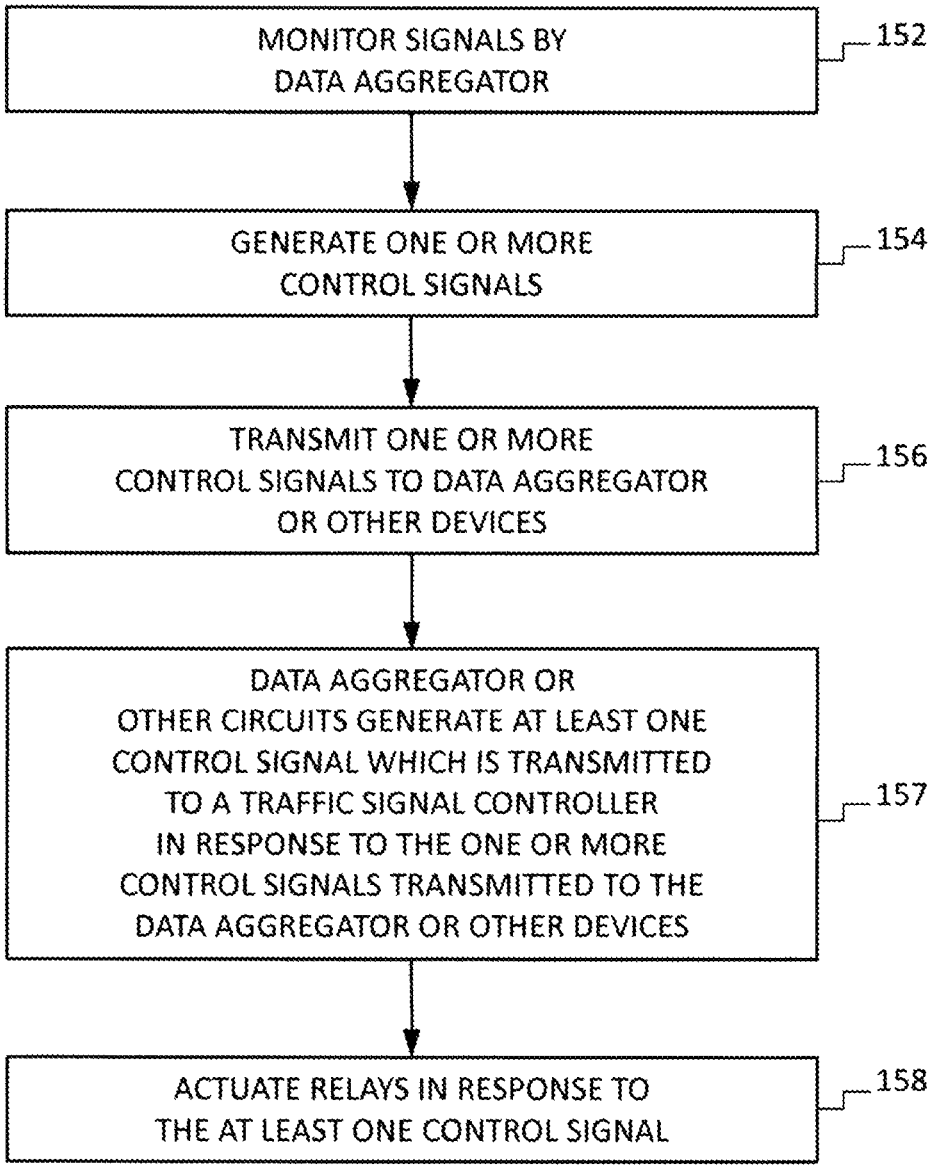
FIG. 4 is a flow diagram for monitoring traffic in accordance with an embodiment of the present invention.

FIG. 4 is a flow diagram 150 illustrating a method for processing traffic information in accordance with an embodiment of the present invention. In operation, data aggregator 14 monitors devices (box 152) such as, for example Bluetooth-compatible devices, cellular-based communications devices, WiFi-compatible devices, or the like, in or on a vehicle passing by an intersection having, for example, a traffic signal. Alternatively, data aggregator 14 can monitor Dedicated Short Range Communications (DSRC) data provided by, for example, radio transceiver 34 which receives its information from traffic signal controller 16 and it can monitor signals between MMU 18 and, for example, traffic signal head 30. In addition, data aggregator 14 monitors signals over the SDLC communications port and broadcasts those signals to cloud-based network of circuit elements 35 to provide end users with information about the operation of the intersection; and information regarding the functioning of controller cabinet 12 such as, for example, whether the cabinet door is open or closed; whether the cabinet fan is on or off; whether the cabinet heater is on or off; whether the battery backup system status is on or off; whether the battery backup system is charging; the charge level of the battery backup system; the charge level of the internal system battery; whether the internal battery is charging; whether the stop time is on or off; whether the cabinet is operating in Flash or not; whether the police switch is on or off; and the operation of the photocell.

In addition, data aggregator 14 can receive signals from one or more of an inductive loop, a magnetometer, a video detector, a radar, and a laser (illustrated by box 39 in FIG. 1).

Data aggregator 14 broadcasts the Media Access Control (MAC) address of the WiFi device to cloud-based network of circuit elements 35, which processes the information to generate one or more control signals indicated by box 154. The control signal or control signals are transmitted from cloud-based network of circuit elements 35 to data aggregator 14 or to DSRC radio transceiver 34 indicated by box 156.

In accordance with an embodiment and in response to the control signal or control signals received from cloud-based network of circuit elements 35, data aggregator 14 or other circuits generate at least one control signal in response to the control signal or control signal (indicated by box 157). In response to the at least one control signal from data aggregator 14, traffic signal controller 16 generates at least one control signal to actuate relays associated with traffic signal head 30 to change at least one lamp 30A, 30B, 30C from on to off or from off to on, i.e., the at least one lamp is configured to emit light or to stop emitting light indicated by box 158. By way of example, traffic signal controller 16 manages and provides output signals to a traffic signal head 30 to change the states of the lamps in the signal head from green to yellow to red. It should be noted that the pattern for changing the states of the lamps in traffic signal head 30 is not a limitation of the present invention and that pattern may be from red to green or yellow to green, etc. It should be further noted that the action performed in response to the one or more control signals is not limited to switching on or off lamps in signal head 30.

By now it should be appreciated that a monitoring system and a method for monitoring traffic have been provided. The monitoring system includes a data aggregator 14 that can receive many different types of information about the signal cabinet, traffic signal head, traffic conditions, vehicle speeds and directions, etc. and transmit this information to the Cloud for further processing and generation of control signals. The data aggregator includes an antenna and may be coupled to a DSRC source, cellular APN services, and WEB services. In accordance with embodiments of the present invention, information can be communicated to and from controller cabinet 12.

Although specific embodiments have been disclosed herein, it is not intended that the invention be limited to the disclosed embodiments. Those skilled in the art will recognize that modifications and variations can be made without departing from the spirit of the invention. It is intended that the invention encompass all such modifications and variations as fall within the scope of the appended claims.

What is claimed is:

1. A method for controlling traffic, comprising:

providing a data aggregator configured to receive data related to traffic or a traffic control cabinet, a traffic signal controller coupled to the data aggregator, and a malfunction management unit coupled to the traffic signal controller and to the data aggregator;

receiving the data related to the traffic or the traffic control cabinet at the data aggregator;

transmitting the data related to the traffic or the traffic control cabinet to a server system;

generating a control signal in response to the data related to the traffic or the traffic control cabinet that has been transmitted to the server system; and using the control signal to control an intersection.

2. The method for controlling traffic of claim 1, wherein receiving the data related to the traffic or the traffic control cabinet at the data aggregator includes receiving an input signal selected from the group of signals comprising a signal from an intersection monitor, a signal from a synchronized intersection, a signal from an unsynchronized intersection, a signal from a traffic data collection apparatus, a signal from a parking management monitor, a signal from a police door, a signal from a traffic control unit, and a signal from a traffic data collector.

3. The method of claim 1, further including using a Synchronous Data Link Control (SDLC) communications protocol to transmit traffic signal controller information.

4. The method of claim 1, wherein generating the control signal includes generating the control signal to include a sync pulse that updates timing information in the traffic signal controller within the traffic control cabinet.

5. The method of claim 1, wherein generating the control signal includes using a global positioning system to transmit the control signal.

6. The method of claim 1, wherein the data related to traffic comprises a signal from one or more of an inductive loop, a magnetometer, a video detector, a radar, and a laser.

7. A traffic monitoring system, comprising:

a data aggregator having a first input terminal, a first output terminal, and an input/output terminal;

a malfunction management unit having an input/output terminal, the input/output terminal of the malfunction management unit coupled to the input/output terminal of the data aggregator; and a traffic signal controller coupled to the data aggregator.

8. The traffic monitoring system of claim 7, further including:

an antenna coupled to the first output terminal of the data aggregator; and wherein the data aggregator further includes a second input terminal coupled for receiving a time sync signal.

9. The traffic monitoring system of claim 7, further including a time sync signal generator coupled to the data aggregator.

10. The traffic monitoring system of claim 7, further including a cloud-based server system coupled to the traffic monitoring system.

* * * * *